United States Patent [19]

Dumas et al.

[11] 4,119,240

[45] Oct. 10, 1978

[54] POSITIVE OPEN RECEPTACLE

[76] Inventors: Sarah J. Dumas; Hal S. Dumas, Jr., both of 300 Brentwood Dr., NE., Atlanta, Ga. 30305

[21] Appl. No.: 753,888

[22] Filed: Dec. 23, 1976

[51] Int. Cl.[2] ..... B65D 43/16; B65D 43/26

[52] U.S. Cl. ..... 220/331; 220/263

[58] Field of Search ..... 220/331, 263, 264; 248/134, 147

[56] References Cited

U.S. PATENT DOCUMENTS

| | | | |
|---|---|---|---|
| 3,008,604 | 11/1961 | Garner | 220/263 X |
| 3,384,385 | 5/1968 | Cohen et al. | 220/331 X |
| 3,422,988 | 1/1969 | La Franca | 220/331 |
| 3,995,764 | 12/1976 | Zagami | 220/263 |

*Primary Examiner*—William Price
*Assistant Examiner*—Steven M. Pollard
*Attorney, Agent, or Firm*—B. J. Powell

[57] ABSTRACT

A closable refuse receptacle unit including a receptacle defining an open top refuse receiving chamber therein; a cover pivotally mounted on the receptacle to close the refuse chamber; and means for positively holding the cover in an open position.

2 Claims, 7 Drawing Figures

Fig 1
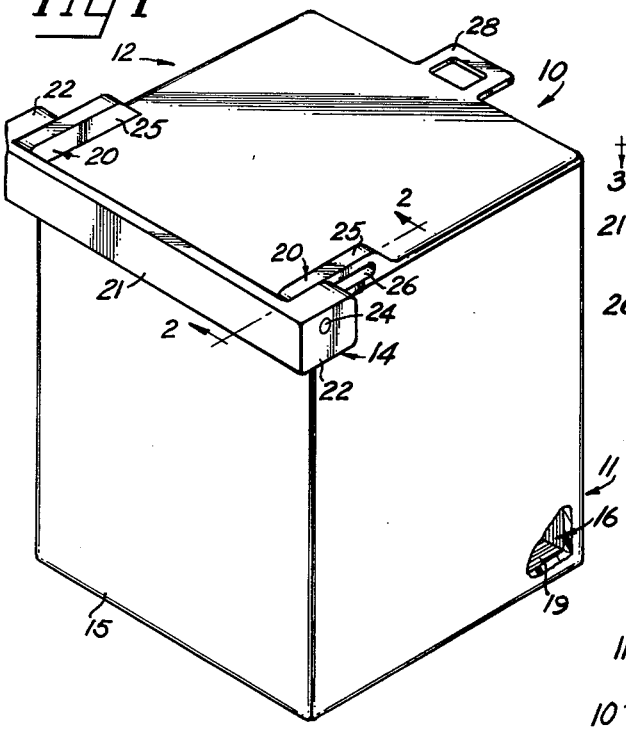
Fig 2
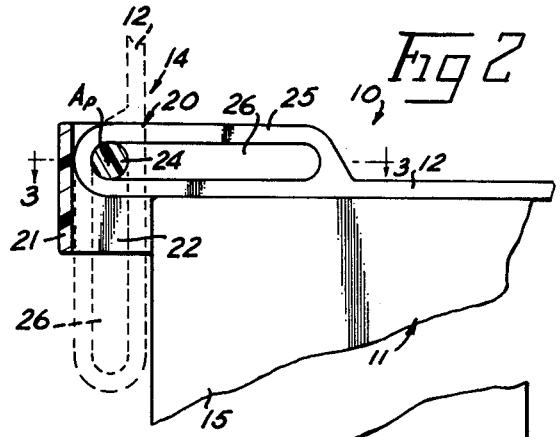
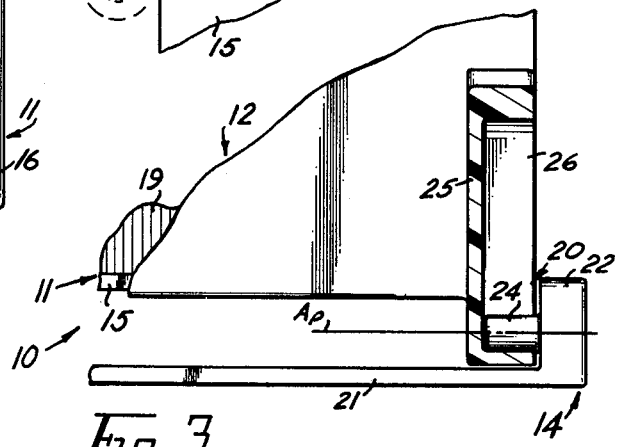
Fig 3
Fig 4
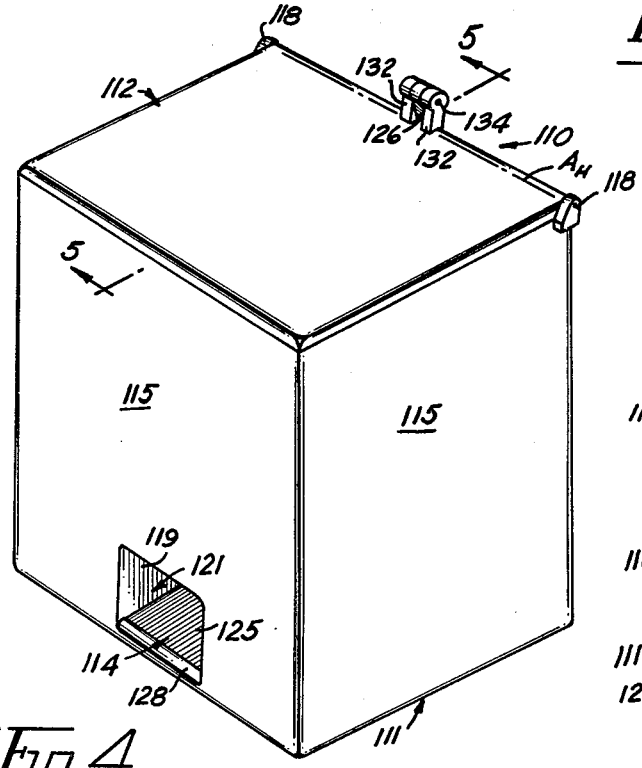
Fig 5
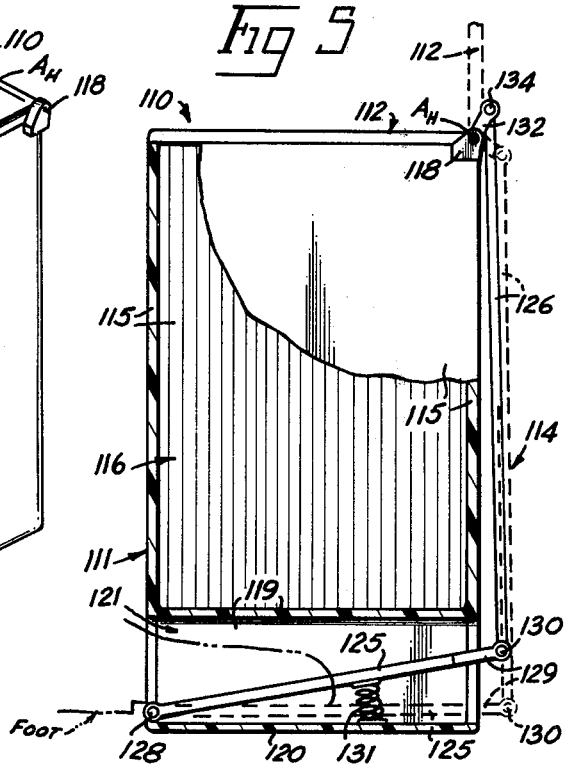

POSITIVE OPEN RECEPTACLE

BACKGROUND OF THE INVENTION

Closable refuse containers are available on the market which have pivoting covers that are permanently attached to the refuse receptacle to close the top thereof. One of the primary problems associated with such prior art refuse receptacles, however, is that it is usually difficult to keep the cover open while the receptacle is being filled. Some refuse receptacles with a pivoting cover have a foot operated mechanism which positively holds the cover in an open position, however, such refuse receptacles are generally unstable while they are being operated, especially when the refuse receptacle is empty.

SUMMARY OF THE INVENTION

These and other problems and disadvantages associated with the prior art are overcome by the invention disclosed herein by providing a refuse receptacle with a cover which is permanently hinged to the refuse receptacle to close same which includes a provision for positively holding the cover open yet readily accessible to close same. The invention also provides a foot operated mechanism which positively maintains the receptacle stable while it is being operated.

The apparatus of the invention includes generally a receptacle which defines an open top refuse chamber therein to which is pivoted a cover for selectively closing the open top of the refuse chamber. The hinge mechanism which pivotally mounts the cover on the receptacle allows the cover to pivot to close the refuse chamber in the receptacle and also positively holds the cover in an open position when it is opened to allow the refuse chamber to be filled. Another embodiment of the invention provides a foot operated mechanism which positively opens a cover hinged to the receptacle where the force applied to the foot operated mechanism positively forces the receptacle toward a stable position.

These and other features and advantages of the invention will become more clearly understood upon consideration of the following specification and accompanying drawings wherein like characters of reference designate corresponding parts throughout the several views and in which:

BRIEF DESCRIPTION OF THE DRAWINGS

FIG. 1 is a perspective view of one embodiment of the invention;

FIG. 2 is an enlarged cross-sectional view taken generally along line 2—2 in FIG. 1;

FIG. 3 is a cross-sectional view taken generally along the line 3—3 in FIG. 2;

FIG. 4 is a perspective view of a second embodiment of the invention;

FIG. 5 is a cross-sectional view taken along the line 5—5 in FIG. 4;

Figure 6:
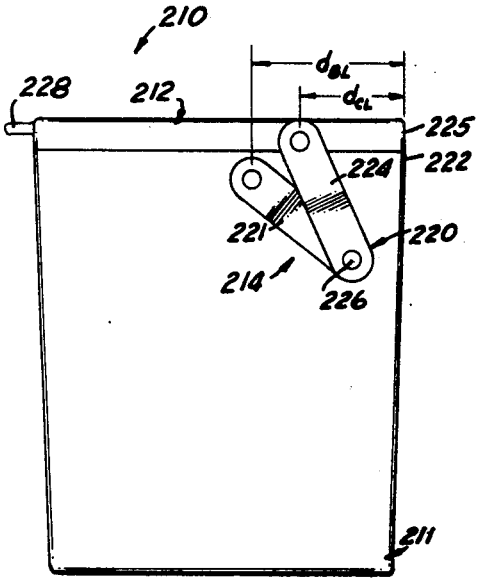
FIG. 6 is a side elevational view of a third embodiment of the invention; and, FIG. 7 is a view similar to FIG. 6 showing the cover in an open position.

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Referring to FIGS. 1–3, a first embodiment of the invention is shown which is designated as a receptacle unit 10 comprising a receptacle 11, a cover 12, and a hinge mechanism 14 which pivotally connects the cover 12 to the receptacle 11. The receptacle 11 includes side walls 15 and bottom wall 19 which define an open top refuse receiving chamber 16 therein. The cover 12 is designed to cover the open top of the refuse receiving chamber 16 when it is closed as illustrated in FIG. 1.

The hinge mechanism 14 includes a pair of hinge assemblies 20 connected by an abuttment plate 21. Each hinge assembly 20 includes a pivot support block 22 mounted on one corner of the receptacle 11 on the outboard side of one of the side walls 15 and extends upwardly therefrom. Each pivot support block 22 mounts a hinge pin 24 thereon which extends inwardly over the top of the side wall 15. The hinge pins 24 are opposed yet coaxially aligned along pin axis $A_p$ which is located just above the top of one of the side walls 15 and just outboard thereof as best seen in FIGS. 2 and 3.

Each hinge assembly 20 also includes a hinge plate 25 on the outboard edge of the cover 12 which cooperates with the hinge pin 24 to pivotally mount the cover 12 on the receptacle 11. Each hinge plate 25 defines an outwardly opening hinge pin recess 26 therein that is sized to slidably and pivotally receive the hinge pin 24 therein as best seen in FIGS. 2 and 3. The recesses 26 are elongated so that the hinge pins 24 are located in the outboard ends of the recesses 26 when the cover is closed as seen in FIGS. 2 and 3 by solid lines but can slidably move to the inboard ends of the recesses 26 when the cover 12 is in its open position as seen by dashed lines in FIG. 2.

The abuttment plate 21 connecting the hinge assemblies 20 extend between the pivot support blocks 22 and is spaced outboard of the side wall 15 of the receptacle 11 just sufficiently for the cover 12 to pivot to its closed position when the hinge pins 24 are located on the outboard ends of the recesses 26. It will be noted that the outboard end of the hinge plates 25 are rounded as best seen in FIG. 2 to permit the cover 12 to pivot when the hinge pins 24 are located in the outboard end of the recesses 26. When the cover 12 is opened, the hinge plates 25 will slide vertically down between the abuttment plate 21 and the outside of the side wall 15. The abuttment plate 21 and the side wall 15 will, however, prevent the cover 12 from further pivoting and thus hold the cover 12 in an upright position shown by the dashed lines in FIG. 2. To reclose the cover 12, the operator simply lifts up on the cover with the handle 28 until the hinge pins 24 are again located in the outboard ends of the recesses 26 whereupon the cover 12 can be pivoted back to its closed position as seen in FIG. 1. The fact that the cover 12 will be positively retained in its opened position also facilitates the dumping of the receptacle 11.

Referring to FIGS. 4 and 5, a second embodiment is illustrated as receptacle unit 110 which includes a receptacle 111, a cover 112 hinged to receptacle 111, and a foot operating opening mechanism 114 to selectively open and close the cover 112. The receptacle 111 includes side walls 115 and bottom wall 120 which define an open top refuse receiving chamber 116 therein that is closed by the cover 112. The cover 112 is hinged to the receptacle 111 along one of the side walls 115 by pivot brackets 118 so that the cover 112 has a hinge axis $A_H$ seen in FIG. 4. The receptacle 111 also includes sub-walls 119 which extend between the side walls 115 and the bottom wall 120 to define foot chamber 121 that opens through the front side wall 115 and the back side wall 115 as seen in FIG. 5. It will be noted that the foot chamber 121 is smaller than the width of side walls 115.

The foot operated opening mechanism 114 includes generally a foot pedal 125 which is movably mounted in the foot chamber 121 and which is connected to the cover 112 by transfer link 126 as best seen in FIG. 5. The foot pedal 125 is pinned in the bottom of the foot chamber 121 at the front end of the receptacle 111 as indicated at 128 and has a driving extension 129 thereon which projects rearwardly out of the foot chamber 121 rearwardly of the back side wall 115 as best seen in FIG. 5. The driving extension 129 is pinned to the lower end of the transfer link 126 as indicated at 130 so that the transfer link 126 is moved up and down as the foot pedal 125 is pivoted up and down about the pinned joint 128. A return spring 121 may be provided to return the foot pedal 125 to its upward pivotal position as seen in FIG. 5 as will become more apparent. The cover 112 is provided with a pair of upstanding hinge ears 132 centrally of the rear edge thereof that project rearwardly of the cover 112. The hinge ears 132 are pinned to the upper end of the transfer link 126 at the pinned joint 134. The length of the transfer link 126 is selected so that when the cover 112 is closed as seen in FIG. 5, the foot pedal 125 will be in its upwardly pivotal position shown by solid lines in FIG. 5. The foot chamber 121 is sized so that a person's foot shown by phantom lines in FIG. 5 can be inserted into the foot chamber 121 above the foot pedal 125. The person then presses down on the foot pedal 125 with a force acting through the support area of receptacle 111 thus forcing it against the floor. This moves the foot pedal 125 to the position shown by dashed lines in FIG. 5 which in turn pulls the transfer link 126 downwardly along with the hinge ears 132 on the cover 112 to pivot the cover to its upright position as shown by dashed lines in FIG. 5. When the person's foot is removed from the foot pedal 125, the return spring 131 urges the foot pedal 125 upwardly to close the cover 112. This closing movement is assisted by the weight of the cover 112. Thus, the unit 110 is stable at all times.

Figure 7:
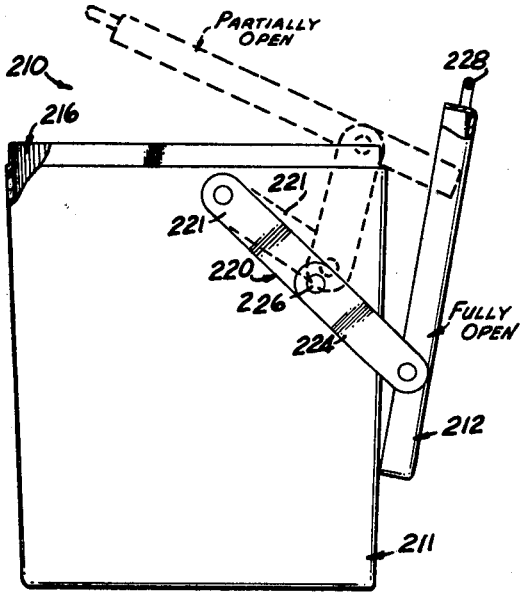

Referring to FIGS. 6 and 7, a third embodiment of the invention is illustrated as a receptacle unit 210 comprising a receptacle 211, a cover 212, and a hinge mechanism 214 which pivotally connects the cover 212 to the receptacle 211. The receptacle 211 defines an open top refuse receiving chamber 16 therein and the cover 212 is designed to selectively cover the open top of the refuse receiving chamber 16 when it is closed as illustrated in FIG. 6.

The hinge mechanism 214 includes a pair of hinge assemblies 220 connecting opposite sides of the cover 212 with opposite sides of the receptacle 211. While only one hinge assembly 220 is illustrated in FIGS. 6 and 7, it is to be understood that the other hinge assembly 220 connects the opposite side of the cover 212 with the opposite side of the receptacle 211. Each hinge assembly 220 includes a base link 221 which is pinned to the receptacle 211 adjacent the upper end thereof and forwardly of the rear edge 222 of the receptacle 211 the distance $d_{BL}$ as seen in FIG. 6 and a cover link 224 which is pinned at one end to the side of the cover member 212 forwardly of the rear edge 225 thereof the distance $d_{CL}$ also seen in FIG. 6. The opposite ends of the links 221 and 224 are pinned together by the floating pin 226. The pin 226 connects the links 224 so that they can pivot with respect to each other and the pin 226 can move with respect to the receptacle 211.

A handle 228 is provided on the front of the cover 212 so that the cover 212 can be lifted from the top of the receptacle 211 as permitted by the hinge assembly 220 as seen by dashed lines in FIG. 7. When the cover 212 is pushed rearwardly after it has been lifted, the cover 212 will slip over the back of the receptacle 211 to the position seen in FIG. 7 where the links 221 and 224 are generally coaxially aligned and the cover 212 is generally vertically oriented behind the receptacle 211 with the refuse receiving chamber 216 open so that refuse can be dumped therein. To close the receptacle 211, the handle 228 is lifted to lift the cover 212 thereby pivoting the links 221 and 224 with respect to each other and with respect, to both the cover 212 and the receptacle 211.

While specific embodiments of the invention have been disclosed herein, it is to be understood that full use may be made of modifications, substitutions and equivalents without departing from the scope of the inventive concept.

What is claimed as invention is:

1. A refuse receptacle unit including:

a receptacle having opposed sides and a bottom wall, and defining an open top refuse chamber and foot chamber therein where said foot chamber is separated from said refuse chamber and is located immediately above the bottom wall;

a cover adapted to cover the open top of said refuse chamber;

hinge means pivotally mounting said cover on said receptacle for pivotal movement of said cover between a closed position in which said cover closes the open top of said refuse chamber, and an open position in which the open top of said refuse chamber is not closed; and, a foot operated mechanism for operating said cover, said foot operated mechanism including a foot pedal having opposed ends within said foot chamber over said bottom wall, one end of said foot pedal pivotally mounted on said receptacle in said foot chamber at one side of said receptacle; and a transfer link pinned to the opposite end of said foot pedal adjacent that side of said receptacle opposite the side which pivotally mounts said foot pedal, said transfer link further connected to said cover so that when said foot pedal is manually depressed intermediate its opposed ends within said foot chamber and toward said bottom wall, said transfer link will cause said cover to be moved toward its open position while the manually depressing force on said foot pedal acts downwardly through said bottom wall of said receptacle to prevent tipping of said receptacle.

2. The refuse receptacle unit of claim 1 further including spring means operatively associated with said foot pedal to urge said cover toward its closed position.

* * * * *